US011634851B2

(12) United States Patent
Chae et al.

(10) Patent No.: US 11,634,851 B2
(45) Date of Patent: Apr. 25, 2023

(54) WASHING MACHINE

(71) Applicant: LG Electronics Inc., Seoul (KR)

(72) Inventors: Kyosoon Chae, Seoul (KR); Hyundong Kim, Seoul (KR); Sooyoung Oh, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 16/845,918

(22) Filed: Apr. 10, 2020

(65) Prior Publication Data

US 2020/0325616 A1 Oct. 15, 2020

(30) Foreign Application Priority Data

Apr. 12, 2019 (KR) ..... 10-2019-0042788

(51) Int. Cl.
*D06F 39/02* (2006.01)
*D06F 39/08* (2006.01)

(52) U.S. Cl.
CPC ..... *D06F 39/022* (2013.01); *D06F 39/028* (2013.01); *D06F 39/083* (2013.01)

(58) Field of Classification Search
CPC .... D06F 39/022; D06F 39/028; D06F 39/083; D06F 39/02; D06F 33/37; D06F 2105/42; A47L 15/4418
USPC ..... 68/17 R
See application file for complete search history.

(56) References Cited

U.S. PATENT DOCUMENTS 3,881,328 A * 5/1975 Kleimola ..... D06F 39/022 68/17 R
5,826,749 A * 10/1998 Howland ..... B01J 4/008 222/144.5
6,367,504 B1 * 4/2002 Knapp ..... F16K 11/0743 251/185
8,555,679 B2 * 10/2013 Schulze ..... D06F 39/022 68/17 R
9,109,710 B2 * 8/2015 Hasse ..... D06F 39/022
10,132,022 B2 * 11/2018 Leibman ..... D06F 39/028
2006/0272360 A1 * 12/2006 Hsu ..... A47L 15/4472 68/19

(Continued)

FOREIGN PATENT DOCUMENTS

CN 103276563 9/2013
CN 105088688 11/2015

(Continued)

OTHER PUBLICATIONS

Ban et al., "Detergent delivery assembly for washing machine, and conversion valve thereof", Nov. 2014, WO-2014180021—Machine Translation (Year: 2014).*
Extended European Search Report in European Application No. 20169304.1, dated Aug. 27, 2020, 7 pages.
PCT International Search Report in International Application No. PCT/KR2020/004931, dated Aug. 3, 2020, 4 pages.

(Continued)

*Primary Examiner* — David G Cormier
*Assistant Examiner* — Thomas Bucci
(74) *Attorney, Agent, or Firm* — Fish & Richardson P.C.

(57) ABSTRACT

A washing machine includes a tub containing water, a drum disposed rotatably in the tub, the drum receiving laundry and a detergent supply device supplying detergent to the tub, wherein the detergent supply device comprises a plurality of cartridges respectively containing detergent, a pump sucking detergent contained in the plurality of cartridges and a passage switching valve selectively allowing the pump to be fluidly communicated with one of the plurality of cartridges.

14 Claims, 16 Drawing Sheets

(56) References Cited

U.S. PATENT DOCUMENTS

| | | | | |
|---|---|---|---|---|
| 2008/0235880 | A1 | 10/2008 | Kim et al. | |
| 2010/0161143 | A1 | 6/2010 | Smith et al. | |
| 2011/0139820 | A1* | 6/2011 | Kessler | A47L 15/4454 134/93 |
| 2012/0096901 | A1* | 4/2012 | Zattin | D06F 39/02 68/13 R |
| 2012/0096903 | A1* | 4/2012 | Kim | D06F 39/02 68/17 R |
| 2012/0291916 | A1 | 11/2012 | Hwang | |
| 2013/0312463 | A1* | 11/2013 | Kim | D06F 39/022 222/173 |
| 2015/0238066 | A1* | 8/2015 | Wang | A47L 15/4427 137/115.11 |
| 2017/0037558 | A1* | 2/2017 | Dunsbergen | D06F 39/02 |
| 2017/0055803 | A1* | 3/2017 | Ayvazoglu | A47L 15/449 |
| 2017/0107657 | A1 | 4/2017 | Kim et al. | |
| 2017/0167068 | A1* | 6/2017 | Bao | B01F 25/3121 |
| 2017/0191206 | A1* | 7/2017 | Jung | F04B 49/02 |
| 2019/0092616 | A1* | 3/2019 | Hikem | D06F 39/022 |

FOREIGN PATENT DOCUMENTS

| | | | | |
|---|---|---|---|---|
| CN | 103290657 | | 3/2016 | |
| EP | 1688529 | | 8/2006 | |
| EP | 2405052 | | 1/2012 | |
| EP | 2521811 | B1 | 3/2015 | |
| JP | 2017121393 | | 7/2017 | |
| JP | 2018011618 | | 1/2018 | |
| KR | 1019990074113 | | 10/1999 | |
| KR | 1020090101679 | | 9/2009 | |
| KR | 1020110099288 | | 9/2011 | |
| KR | 1020130062271 | | 6/2013 | |
| WO | WO2008115017 | | 9/2008 | |
| WO | WO-2014180021 | A1 * | 11/2014 | D06F 39/022 |
| WO | WO2015074688 | | 5/2015 | |
| WO | WO2017119593 | | 7/2017 | |

OTHER PUBLICATIONS

Office Action in Chinese Appln. No. 202010285878.X, dated May 20, 2022, 15 pages (with English translation).

* cited by examiner

WASHING MACHINE

CROSS-REFERENCE TO RELATED APPLICATION

This application claims the benefit of priority to Korean Application No. 10-2019-0042788, filed on Apr. 12, 2019, the disclosure of which is incorporated in its entirety.

BACKGROUND OF THE INVENTION

Field of the Invention

The present disclosure relates to a washing machine, and more particularly to a washing machine capable of automatically supplying various detergent.

Related Art

A washing machine is a device handling laundry through washing, dehydration and/or drying and the like. The washing machine is a device removing contamination of a laundry by using water and detergents.

Recently, there is a need to develop a device automatically mixing and providing various detergents according to various laundries, so technical features related therewith are under development.

Japanese Patent Publication No. 2018-11618 discloses a structure of gear pump for automatic detergent supply. According to the prior art as the above, it is possible to selectively extract detergent from only two detergent tanks according to normal rotation/reverse rotation of the motor. In this case, there is a problem that it is impossible to extract detergent from a plurality of cartridges more than three with the method as the above.

SUMMARY OF THE INVENTION

One object of the present disclosure is to provide a washing machine capable of supplying a plurality of detergent with one pump.

Another object of the present disclosure is to provide a washing machine capable of preventing detergent or air from leaking when switching passage so as to supply various detergent.

Objects of the present disclosure should not be limited to the aforementioned objects and other unmentioned objects will be clearly understood by those skilled in the art from the following description.

In accordance with an embodiment of the present disclosure, the above and other objects can be accomplished by the provision of washing machine including a tub containing water, a drum disposed rotatably in the tub, the drum receiving laundry and a detergent supply device supplying detergent to the tub, wherein the detergent supply device comprises a plurality of cartridges respectively containing detergent, a pump sucking detergent contained in the plurality of cartridges and a passage switching valve selectively allowing the pump to be fluidly communicated with one of the plurality of cartridges.

The pump may comprise a cylinder and a piston moving reciprocatively in the cylinder.

The passage switching valve may comprise an upper housing which is connected to the cylinder and receives a fluid pressure from the pump therein.

The detergent supply device may further comprise a water supply valve for receiving water from an external water source, and an outlet passage through which detergent contained in the cartridge flows into the tub or the drawer.

The passage switching valve may be connected to the water supply valve to guide water supplied from the water supply valve to the outlet passage.

The passage switching valve may comprise an upper housing in which water supplied from the water supply valve is received.

A water supply passage may be disposed between the upper housing and the water supply valve.

The passage switching valve may comprise an upper housing disposed at an upper side of the passage switching valve, a lower housing mounted to a lower side of the upper housing, the lower housing having a plurality of passage holes through which fluid discharged from or sucked into pump is passed and a plurality of spring valves opening or closing at least one of the plurality of passage holes.

The spring valve may comprise a cover unit opening or closing at least one of the plurality of passage holes, a spring providing an elastic force to the cover unit and a spring shaft supporting the spring.

The passage switching valve may further comprise a disc disposed rotatably in a space formed between the upper housing and the lower housing, wherein the spring valve is installed at the disc, wherein the spring valve opens or closes the passage holes according to a rotation of the disc.

The passage switching valve may further comprise a passage switching motor rotating the disc and a shaft transferring a rotary power generated by the passage switching motor to the disc.

The washing machine may further comprise a controller controlling the passage switching motor.

The passage switching valve may further comprise a micro switch detecting a rotary position of the disc, wherein the controller controls the rotation of the passage switching motor according to the rotary position of the disc.

A disc hole may be formed at the disc, wherein one end of the spring valve is inserted into the disc hole.

The lower housing may further comprise passage outlet openings respectively connected to each of the plurality of cartridges, wherein the passage outlet openings are fluidly communicated with the passage holes.

The washing machine may comprise a tub containing water, a drum disposed rotatably in the tub, the drum receiving laundry and a detergent supply device supplying liquid-phase additive to the tub, wherein the detergent supply device comprises a plurality of cartridges containing the additive, a pump sucking the additive contained in two or more cartridges of the plurality of cartridges, a passage switching valve selectively causing the pump to be communicated to one of the cartridges.

The washing machine including the same according to the present disclosure provide at least the following effects.

First, the washing machine according to an exemplary embodiment of the present disclosure has an advantage of supplying various detergent with one pump through passage switching valve.

Second, the washing machine according to an exemplary embodiment of the present disclosure has an advantage of preventing detergent or air from leaking through a spring valve so as to supply detergent stably.

It should be understood that advantageous effects according to the present invention are not limited to the effects set forth above and other advantageous effects of the present disclosure will be apparent from the detailed description of the present disclosure.

Details of other embodiments will be described in the detailed description with reference to the accompanying drawings.

DESCRIPTION OF EXEMPLARY EMBODIMENTS

Figure 1:
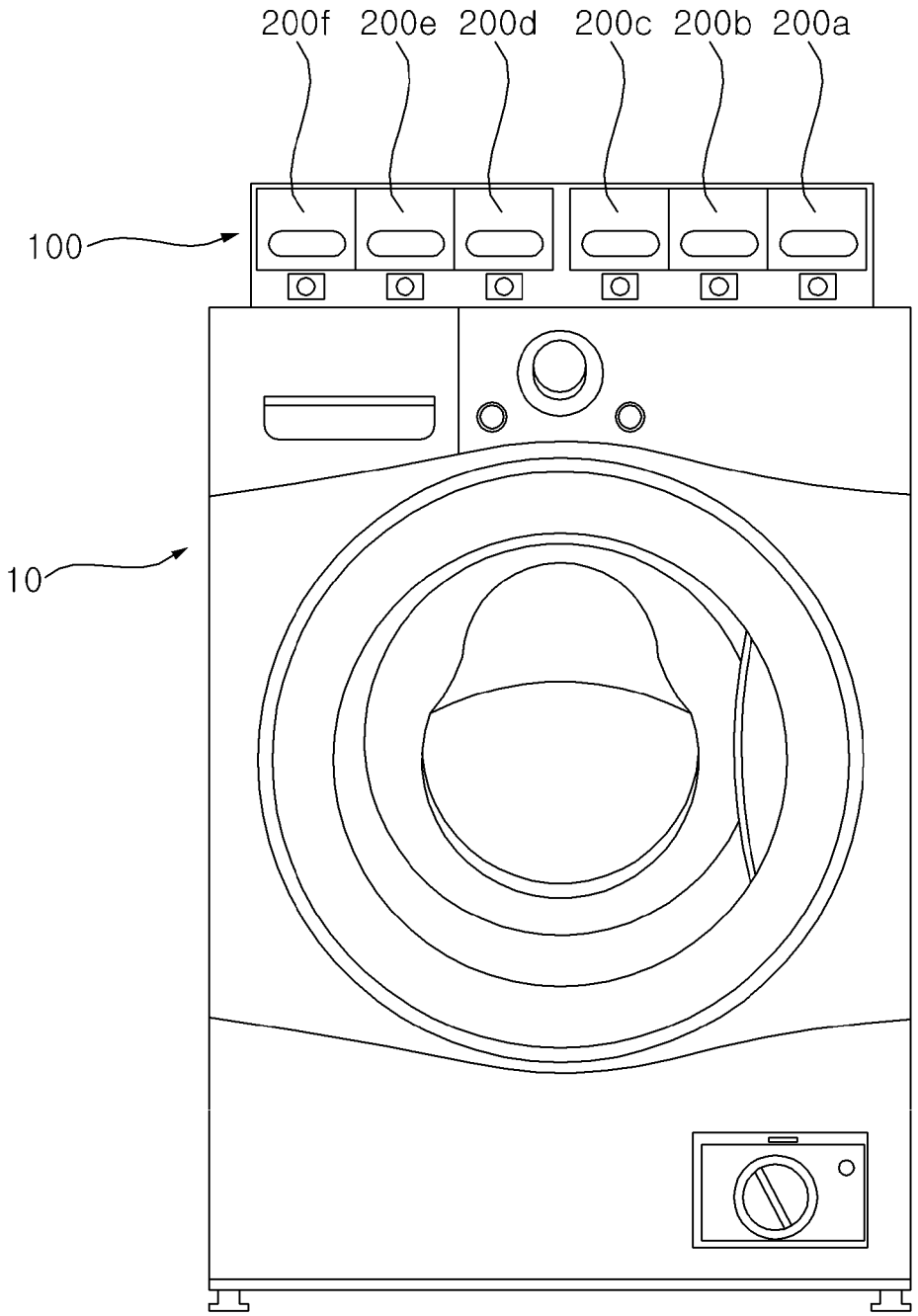
FIG. 1 is a front view showing a washing machine according to an embodiment of the present disclosure.

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the invention is fully understood by those skilled in the art to which the present disclosure belongs, and the present disclosure is only defined by the scope of the claims. The same reference numerals indicate the same components through the specification.

Hereinafter, the present disclosure will be more specifically described with reference the accompanying drawings.

Figure 2:
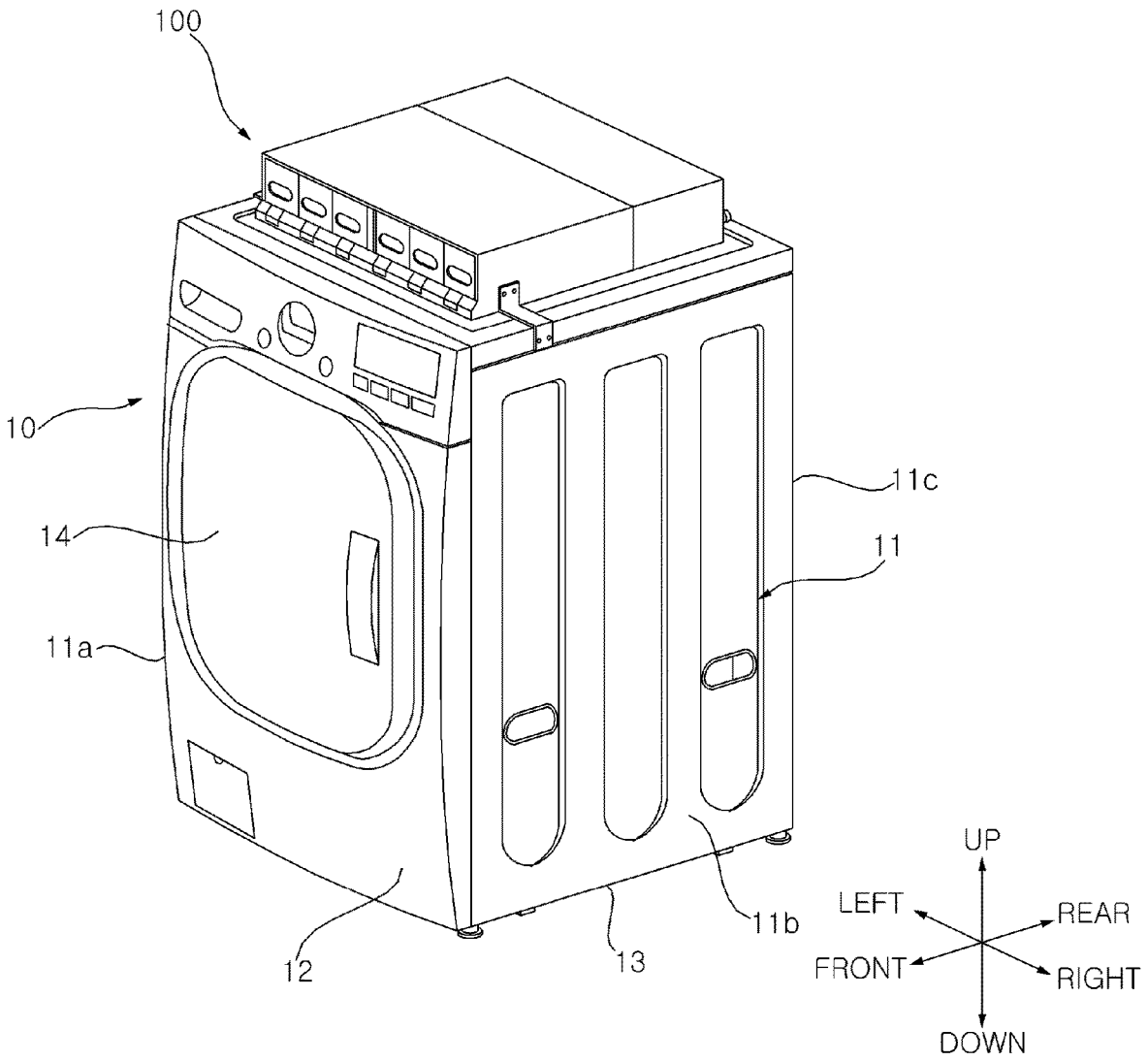
FIG. 2 is a perspective view showing a washing machine according to an exemplary embodiment of the present disclosure.
Figure 3:
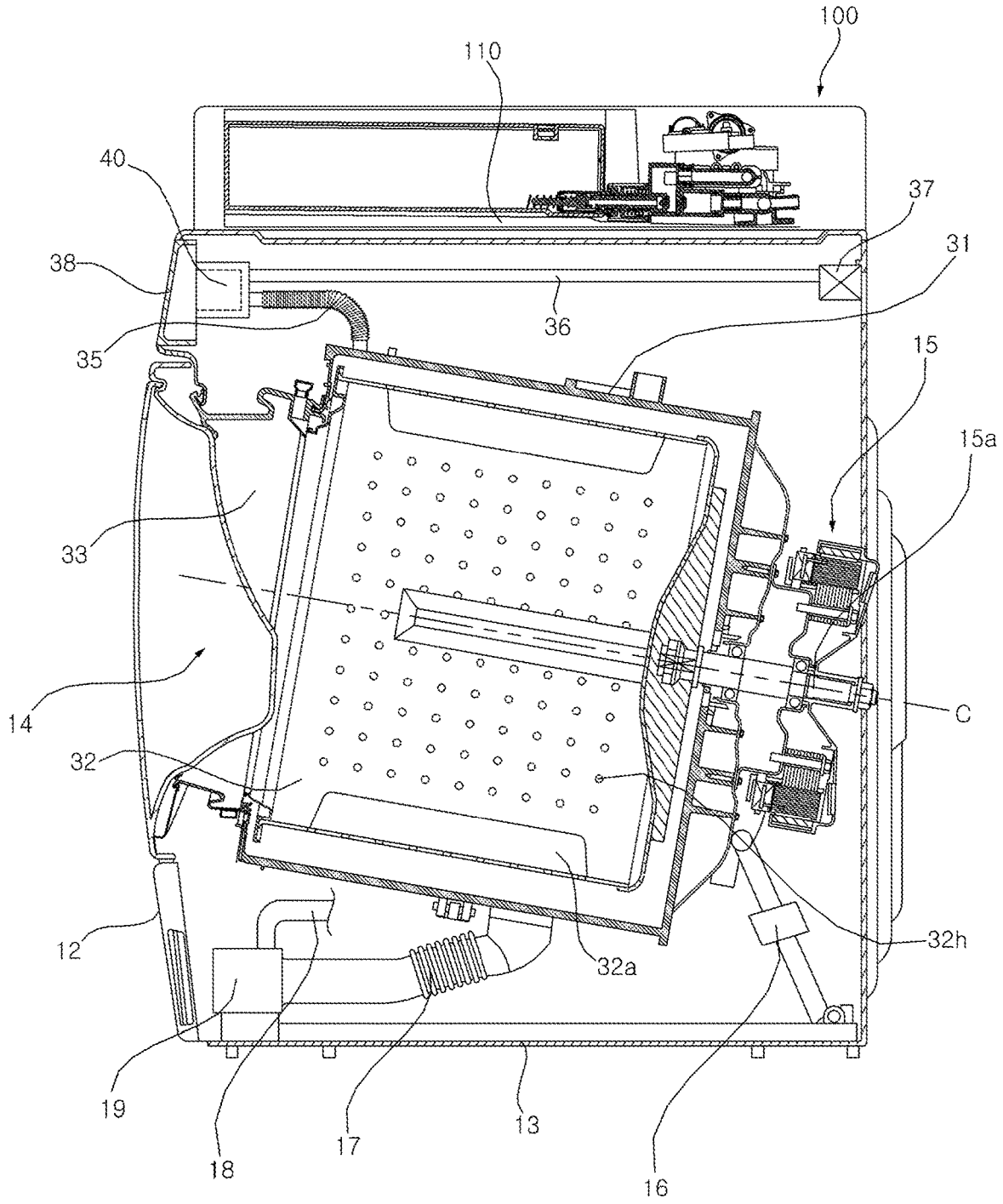
FIG. 3 is a lateral cross-sectional view showing the washing machine according to an exemplary embodiment of the present disclosure.
Figure 4:
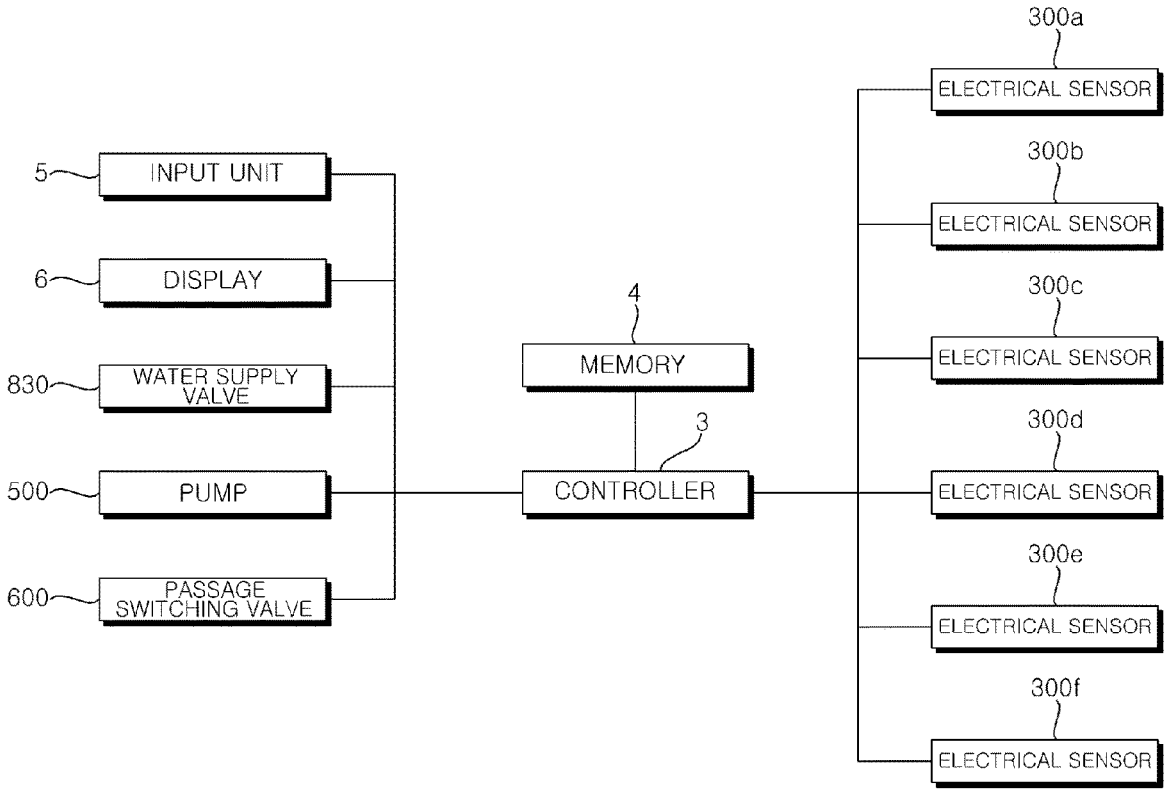
FIG. 4 is a block diagram showing a control of the washing machine according to an exemplary embodiment of the present disclosure.
Figure 5:
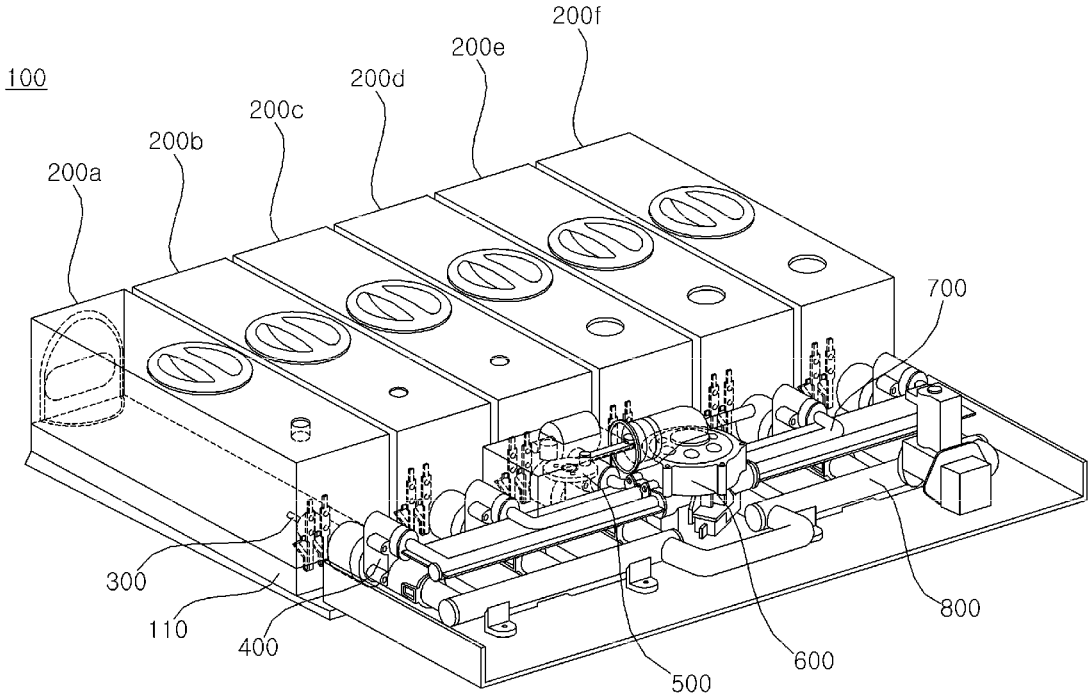
FIG. 5 is a schematic view showing a detergent supply device according to an exemplary embodiment of the present disclosure.
Figure 6:
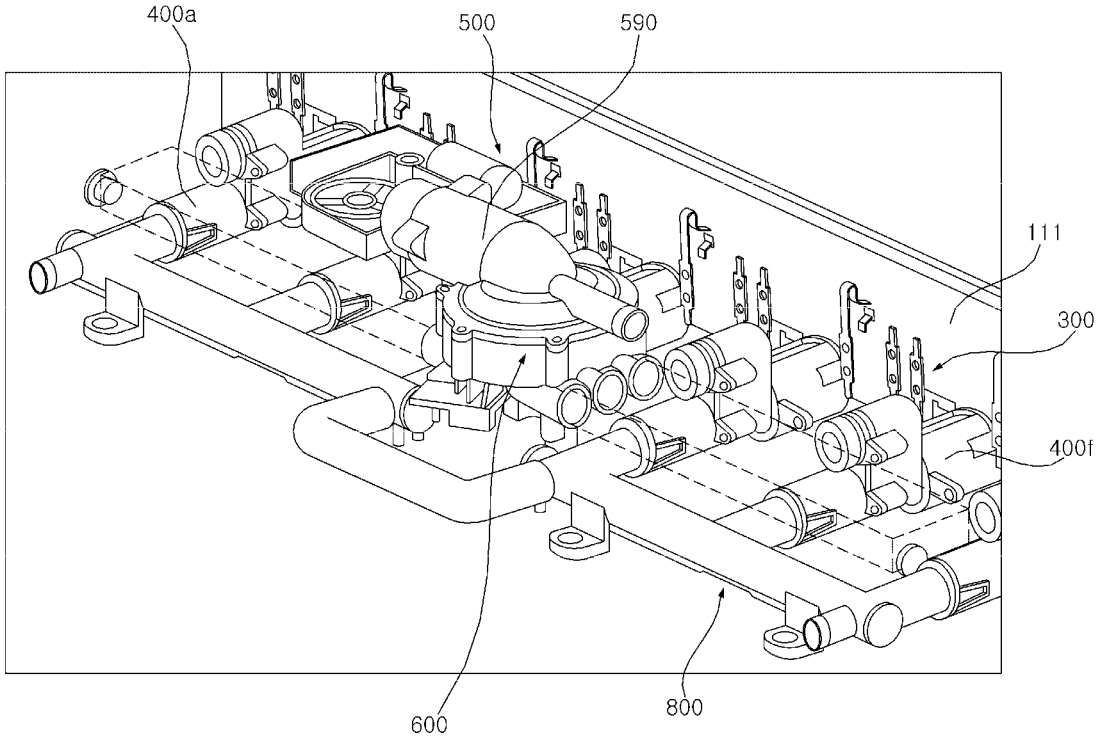
FIG. 6 is a rear view showing the detergent supply device according to an exemplary embodiment of the present disclosure.
Figure 7:
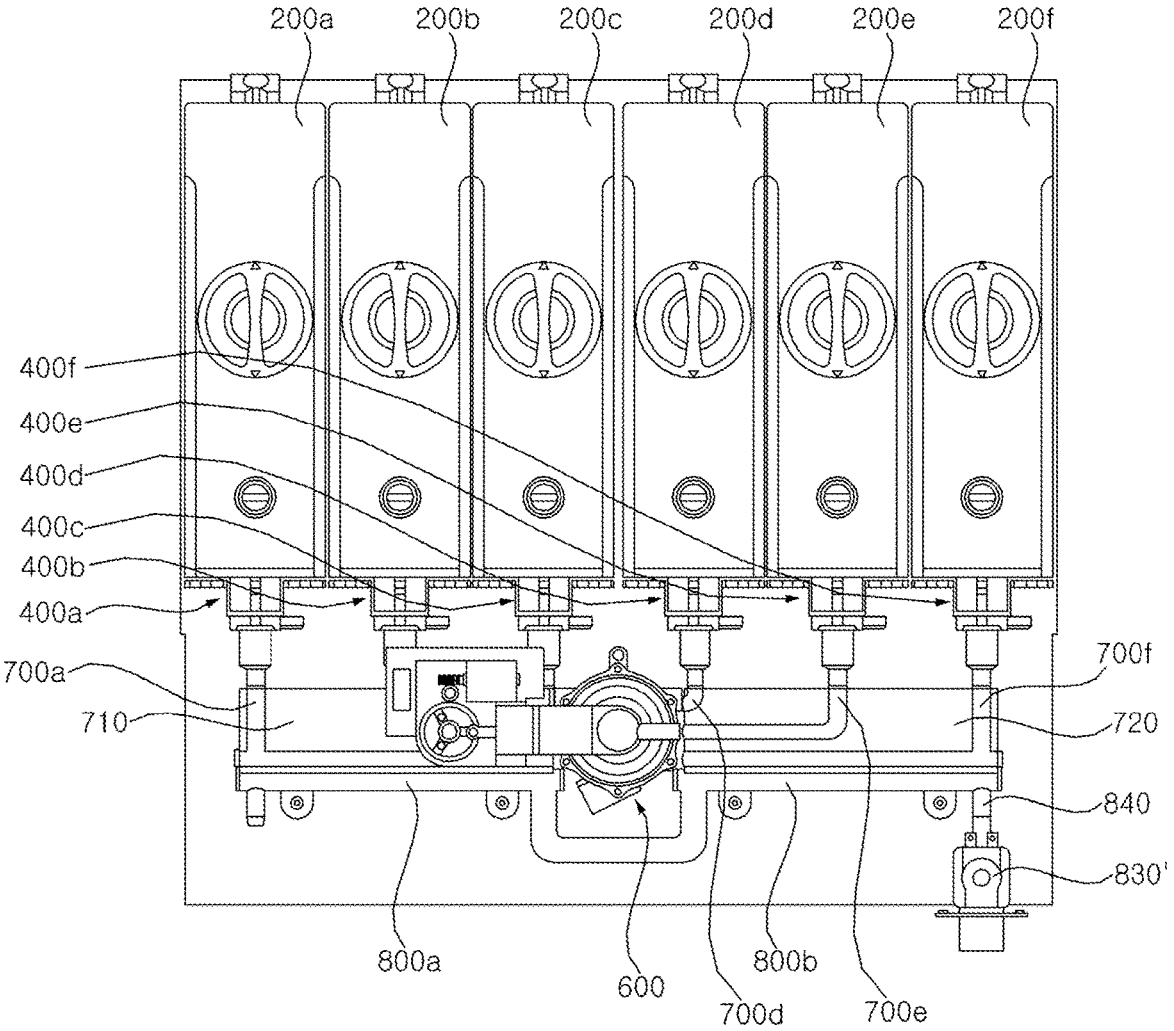
FIG. 7 is schematic view showing the detergent supply device viewed from above according to an exemplary embodiment of the present disclosure.

Referring to FIG. 1 through FIG. 3, a washing machine according to an exemplary embodiment of the present disclosure includes a cabinet 10 and a detergent supply device 100 disposed at an upper surface of the cabinet 10.

The cabinet 10 is formed as an appearance of a washing machine, and a tub 31 and a drum 32 are disposed in the cabinet 10. The cabinet 10 includes a main frame 11 having a front surface opened, a left surface 11*a*, a right surface 11*b* and rear surface 11*c*, a front panel 12 having a loading/unloading opening and connected to the front surface of the main frame 11, and a planar base 13 supporting the main frame 11 and the front panel 12 from the below. A door 14 opening and closing the loading/unloading opening is mounted rotatably to the front panel 12.

The front panel 12 and the tub 31 are communicated to each other through a circular gasket 33. A frontal end portion of the gasket 33 is mounted at the front panel 12, a rear end portion of the gasket 33 is mounted fixedly along a circumference of an inlet of the tub 31. The gasket 33 is formed as a material having elasticity and capable of preventing water in the tub 31 from leaking.

A driving portion 15 is disposed at a rear side of the drum 32 so as to rotate the drum. Further, there may be provided with a water supply hose (not shown) guiding water supplied from an external water source and a water supply portion 37 controlling water supplied from the water supply hose to a water supply passage 36. The water supply portion 37 may include a water supply valve (not shown) opening/closing the water supply passage 36.

The cabinet 10 includes a drawer 38 accommodating additive and a drawer housing 40 accommodating the drawer 38 so that the drawer 38 is withdrawable therefrom. The additive may also include bleach or fabric softener as well as detergent for laundry. Additive accommodated in the drawer 38 is provided to the tub 31 through a water supply bellows 35 when water is supplied through the water supply passage 36. A water supply hole (not shown) connected to the water supply bellows 35 may be disposed at a side of the tub 31.

The tub 31 may include a drain discharging water, and a drain bellows 17 may be connected to the drain. A drain pump 19 pumping water discharged from the tub 31 through the drain bellows 17 so as to discharge the water to the outside of the washing machine.

Hereinafter, a water supply device 100 mounted at an upper surface of the cabinet according to an exemplary embodiment of the present disclosure will be described.

Referring to FIG. 1 through FIG. 8, the water supply device 100 includes a housing 110 having a door disposed at a front side thereof and defining an accommodating room inside thereof, and a cover 120 opening and closing the housing 110.

An opening formed as a rectangular cuboid made of various surfaces is disposed at a front side of the housing 110, and each of the opening is extended from a rear side of the housing 110 so as to form a room for a cartridge corresponding to each of the opening. That is, each of a plurality of cartridges 200*a*, 200*b*, 200*c*, 20*d*, 200*e*, 200*f* (hereinafter referred to as "200") may be inserted to each opening room.

Additive may be contained in each the cartridge 200, and preferably additives having various composition ratio may be contained therein. Liquid-phase additive may be contained in the cartridge 200. The number of the cartridge according to an exemplary embodiment of the present disclosure may be six, but it is not limited thereto. It is preferable to employ three cartridges or more.

An accommodating room is formed at a rear space of the cartridge 200 so that passages 700, 800, a passage switching valve 600 and a pump 500 and something like detergent supply parts are accommodated. A rear wall 111 is installed between the accommodating room and a rear space accommodating parts in which an electrode sensor 300 including a terminal and an electrode sensor 300 as the followings.

A pump 500 and a passage switching valve 600 may be controlled by a controller 3. Information about contents of additive and various composition ratio of contents may be stored in a memory 4. One of the contents is contained in each of the cartridges 200, and the controller 3 controls the pump 500 and the passage switching valve 600 according to information stored in the memory 4.

The washing machine may further include an input unit 5 for obtaining various control command related with an operation of the washing machine from a user. The input unit 5 may be disposed at an upper side of the front panel 12. A display 6 indicating the operating status of the washing machine may be disposed at the front panel 12.

The controller 3 may select a type of additive from the memory 4 according to an input value that a user had input with the input unit 5, and the controller 3 may identify information about the additive. And then, the controller 3 may control the pump 500 and the passage switching valve 600 so as to eject the selected additive. Thus, the controller 3 may control the pump 500 corresponding to the cartridge 200 accommodating the selected additive according to the composition ratio and the passage switching valve 600.

Hereinafter, referring to FIG. 5 through FIG. 8 and FIG. 9, cartridges 200 according to an exemplary embodiment of the present disclosure will be described.

The cartridge 200 includes a cartridge body 210 containing additive and is formed as a base, a first opening 211 allowing additive to go into the cartridge body 210, a cap 220 opening/closing the first opening 211*a*, a membrane 230 allowing air in the cartridge to circulate to outside, a second opening 213 having the membrane 230, a cartridge locker 240 allowing the cartridge 200 to be secured to the housing 110 in a case that the cartridge is insertly installed on the housing 110, a docking valve 250 connecting a check valve assembly 400 and the cartridge 200 and a rib 260 preventing additive from being contacted to the membrane 230.

The cartridge body 210 is formed so as to be insertly mounted to a cartridge accommodating space formed at a front side of the housing 110 in which the cartridge body 210 is formed as being corresponded to an appearance of the housing 110. According to an exemplary embodiment of the present disclosure, a cartridge container 110 is formed as being cuboid-shaped, further the cartridge 200 is also formed as being cuboid-shaped so as to be corresponded thereto, and at this time an edge of the cartridge container 110*a* is formed so as to be rounded.

A docking valve insert opening is formed at a surface of the cartridge body 210, the docking valve 250 may be installed on the cartridge body 210 in a state of being inserted to the docking valve insert opening. The docking valve insert opening may be formed at a rear side of the cartridge body 210. The docking valve insert opening may be disposed at a lower side of the rear side. Herein, even though the cartridge is filled with a little amount of additive, the additive in the cartridge can be discharged through the docking valve 250 to the check valve assembly 400.

As a reason of the forgoing, the cartridge 200 may be installed with a downward slope towards a rear. Specifically, the cartridge 200 may include the cartridge body 210 having a bottom surface disposed with a downward slope toward a direction that the docking valve insert opening is formed. In a case that the docking valve insert opening is disposed at a rear surface of the cartridge body 210, the cartridge 200 may have the cartridge body 210 in which an inner bottom surface of the cartridge body 210 is inclined downward toward a rear.

Hereinafter, referring to FIG. 5 through FIG. 8 and FIG. 10, a structure and an operation of an electrode sensor 300 disposed at a rear side of the cartridge will be described.

The electrode sensor 300 according to an exemplary embodiment of the present disclosure is disposed at the rear wall 111*a* which is formed at a rear side of the cartridge 200 which is inserted in the housing 110. Specifically, electrode plates 321*a*, 321*b*, 321*c* (hereinafter referred to as "321") are installed between the rear wall and the cartridge body 210. A terminal 311*a*, as an example among terminals 311*a*, 311*b*, 311*c* provided is installed on a rear wall protrusions 111*a*1 protruding in an opposite direction to the cartridge. The terminal 311*a* includes a protrusion 311-1 having a curvature bending forward. The protrusion 311-1 may push the electrode plate 321 toward the cartridge simultaneously in a state of being contacted to the electrode plate 321, so an electric signal can be obtained from the electrode plate 321.

The electrode plate 321 is connected to the terminal 311 through a rear wall electrode plate opening 112-1. And the electrode plate 321 is contacted to the inside of the cartridge through a cartridge electrode plate opening (not shown). Thus, an electric current may flow in a state of being contacted with additive contained in the cartridge at the front side, and then an electric signal may be transmitted to the controller 3 through the terminal of rear side.

According to an exemplary embodiment of the present disclosure, three terminals and three electrode plates are respectively disposed per one cartridge. A first terminal 311*a*, a first electrode plate 321*a*, a second terminal 311*b* and a second electrode plate 321*b* are disposed at a lower side of the cartridge and at a side of the docking valve 250.

Third terminal 311*c* and third electrode plates 321*c* are disposed at an upper side of the cartridge and at the other side of the docking valve 250*a*.

The electrode sensor 300 outputs a signal when positive and negative electrodes closely spaced apart from each other is electrified through a medium. Thus, when the cartridge is filled with enough additive, additive functions as a medium so that they are electrified, and in doing so, the terminal determines an amount of additive contained in the cartridge.

In a case that there is provided with two electrode plates of an electrode sensor 300 and two terminals 311 at each cartridge, there may be a problem that the electrode sensor misjudges an amount of additive contained in the cartridge because of sway of the electrode sensor or hardened additive on the electrode sensor.

According to an exemplary embodiment of the present disclosure, the first and second electrode plates 321*a*, 321*b* may be separate. In other words, the first and second electrode plates 321*a*, 321*b* are installed on a lower side of the cartridge 200, and the third electrode plate 321*c* is installed on an upper side of the cartridge 200. That is, when the first and second electrode plates 321*a*, 321*b* are electrified, a first signal can be obtained, and when the first electrode plate 321*a* or second electrode plate is electrified with the third electrode plate 321*c*, a second signal can be obtained. Therefore, it is possible to detect residual quantity of additive by adding the first signal and the second signal, and further it is possible to determine whether the electrode sensor is out of order or unmounted.

Specifically, when the first and second signals are not detected, it is determined that the cartridge is almost empty or unmounted. When only the second signal is detected, it is determined that the electrode sensor is out of order or under bad connection. When only the first signal is detected, it is determined that the cartridge is lack of additive. When the first and second signals are detected, it is determined that the cartridge is filled with enough additive.

The display 6 may indicate a result of the first and second signal so that a user can easily recognize it. Meanwhile, according to an exemplary embodiment of the present disclosure, there is provided with the first and second electrode plate installed on a lower side thereof and the third electrode plate installed on an upper side thereof, but it is not limited thereto. Rather, it is preferable to employ at least three electrode plates or more so as to reduce a chance to misjudge a residual quantity of additive contained in the cartridge.

According to an exemplary embodiment of the present disclosure, the first and second electrode plates 321*a*, 321*b* are formed as being L-shaped rather than a rectangular-shaped as a conventional manner. That is, if the two electrodes are placed closely to each other, a wrong signal can be detected by an interference between the two electrodes. Therefore, a width of a lower side of the electrode plate which detergent is contacted can be made thinly so as to reduce the interference between the first and second electrodes. At this time, an appearance of the electrode plate is not limited to "L"-shaped as long as an interference is minimized.

Hereinafter, referring to FIG. 5 through FIG. 8 and FIG. 11, a structure and an operation of the check assembly 400 will be described.

The check valves 400*a*, 400*b*, 400*c*, 400*d*, 400*e*, 400*f* (hereinafter referring to as "400*a*") according to an exemplary embodiment of the present disclosure include a first check valve housing 410410, a first check valve 420420 installed on the first check valve housing 410, a check valve cap 430 preventing additive and air from leaking through the first check valve 420, a docking pipe 440 mounted to the docking valve 250 so as to guide additive in the cartridge 200 to a direction of the check valve, a docking pipe circumferences 450 mounted to the docking valve at a circumference of the docking pipe, a second check valve housing 460460 installed on the second check valve housing 460 and an outlet passage connector 480 installed on the second check valve housing 460 so as to be connected to the outlet passage 800.

A check valve o-ring 411 may be installed by being inserted between the first check valve housing 410 and the second check valve housing 460 so that the first check valve housing 410 and the second check valve housing 460 are connected to each other, so it is provided with air tight.

The first check valve 420 and the second check valve 470 according to an exemplary embodiment of the present disclosure may be formed as a rubber. As a result of the foregoing, there is no need to employ a spring as conventional manner, because it is possible to block one-way flow of fluid by using an elastic force of a rubber, so it is possible to minimize a space of the housing, and further arrange various parts therein without any space loss.

The first check valve 420 and the second check valve 470 are disposed along an opposite direction to a direction of the cartridge 200. Thus, the first check valve 420 is capable of being opened only in a direction toward a second space S2, and the second check valve 470 is capable of being opened only in a direction toward a third space S3.

A detergent inlet 441 allowing additive supplied from the cartridge 200 to be supplied through docking valve. A first docking pipe o-ring 442 and a second docking pipe o-ring 442*a*-1 are snugly inserted to a first docking pipe o-ring groove 442*a*-1 and a second docking pipe o-ring groove 443*a*-1 respectively at the both sides of the detergent inlet. This is to prevent additive from leaking to the outside while additive is supplied to the detergent inlet.

A docking pipe spring 451 is installed at the docking pipe circumference 450. The docking pipe spring 451 is capable of connecting fixedly the check valve assembly 400 to the docking valve 250 through an elastic force of the docking pipe spring 451*a*, and further is capable of easily disassembling the cartridge 200 from the housing 110 through the elastic force of the docking pipe spring.

The second check valve housing 460 include an inlet passage connector 461 connected to the inlet passage 700 and an outlet passage connectors 463 connected to the outlet passage 800. The inlet passage connector 461 is snugly mounted to the inlet passage 700 through the inlet passage connecting cover 462.

The outlet passage connecting pipe 480 is fixedly connected to an end of the outlet passage connector 463*a* by an outlet passage connecting o-ring 482. The outlet passage connecting pipe 480 is snugly connected to the outlet passage 800 by an outlet passage connecting cover 481.

Negative pressure or positive pressure generated by reciprocating movement of a piston 580 disposed at the pump 500 is guided to the second space S2 of the check valve assembly 400 through the inlet passage 700.

According to an exemplary embodiment of the present disclosure, a negative pressure generated by reverse movement of the piston 580 is guided to the second space S2 through the inlet passage 700. Thus, the first check valve 420 is opened by the negative pressure in the second space S2. At this time, additive of the cartridge 200 is guided to the second space S2 by the negative pressure in the second space S2 via the first space S1 of the docking pipe 440*a* and the first check valve 420.

When the additive is guided to the second space S2, the piston 580 moves forward and then a positive pressure generated by the movement as above is again guided to the second space S2 through the inlet passage 700. At this time, the second check valve 470 is opened by a positive pressure in the second space S2, and the first check valve 420 is kept closed. Therefore, additive in the second space S2 is guided to the third space S3 of the second check valve housing 460 by a positive pressure in the second space S2. Additive guided to the third space S3 is discharged to the outlet passage 800 by positive pressure in the second space S2 and the third space S3 so as to be provided to the tub 31 or drawer 39, etc. with water supplied.

Hereinafter, referring to FIG. 5 through FIG. 8 and FIG. 13, a structure and an operation of the pump 500 will be described.

The detergent supply device 100 may include one pump 500 or more than two pumps. The number of the pump 500 may be less than the number of the cartridge.

The detergent supply device 100 may include one pump 500 and one passage switching valve 600, so as to selectively suck additive contained in the plurality of cartridges.

On the other hand, the detergent supply device 100 may include pumps 500 more than two, and the number of passage switching valves 600 may be the same as the number of the pumps.

For instance, the detergent supply device 100 may include two first and second pumps 500 and two first and second passage switching valves 600. The first pump may be connected to at least one cartridge of the plurality of cartridges through the first passage switching valve so as to selectively suck additive contained therein. The second pump may be connected to the others, e.g., 200*d*, 200*e*, 200*f*, through the second passage switching valve so as to selectively suck additive contained therein.

Alternatively, the detergent supply device 100 may include pumps 500 more than two and the number of passage switching valve 600 may be less than the number of the pumps.

For example, the detergent supply device 100 may include two first and second pumps 500 and one passage switching valve 600. In a case that the detergent supply device 100 is connected to one cartridge of the plurality of cartridges 200, 200*b*, 200*c*, 200*d*, 200*e*, 200*f* rather than the passage switching valve so as to selectively suck additive contained therein, and then the second pump may be connected to the others, e.g., 200*b*, 200*c*, 200*d*, 200*e*, 200*f*, through the passage switching valve so as to selectively suck additive contained therein.

Meanwhile, there is also provided with a plurality of inlet passages 700 as the followings. At least one of the plurality of inlet passages 700 may include passages more than two respectively connected to check valve assemblies more than two of the plurality of check valve assemblies 400.

The pump 500 is able to change a pressure generated in the second space S2 formed at the check valve assembly connected to at least two passages of the inlet passage 700 so as to suck additive, and the passage switching valve 600 is able to connect the pump 500 to one of at least two passages of the inlet passage 700. When the passage switching valve 600 functions to communicate a cylinder 590 of the pump 500 with one passage of at least two passages of the inlet passage 700, the pump 500 is operated. And, then additive is able to be guided to the cylinder 590 and the second space S2 formed at the check valve assembly connected to the one passage.

Meanwhile, in a case that the detergent supply device 100 includes a plurality of pumps 500, it is possible to classify each cartridge connected to another pump, and also to order a user to put additive in the classified cartridge.

For example, it is well known that if ordinary detergent and bleach are mixed, they are likely to be hardened. Therefore, it would order a user to put ordinary detergent into one of cartridge connected to the first pump, and to put bleach into one of cartridge connected to the second pump. Further, baby has weak skin so that it is undesirable to add bleach to clothes for baby. Thus, it also can be marked on each cartridge for a user to put detergent for baby clothes into one cartridge connected to the first pump, and to put bleach into the other one of the cartridge connected to the first pump.

Hereinafter, a case that a detergent supply device 100 employing one pump 500 will be described, but it is not limited thereto. It is preferable to employ at least two cartridge 200 connected to at least one pump 500 via a passage switching valve 600, an inlet passage 700 and a check valve assembly 400.

The pump 500 according to an exemplary embodiment of the present disclosure includes a pump housing 510 accommodating pump parts, a motor 520 generating power, a first gear 530 rotated by the motor 520, a second gear 540 rotating in a state of being engaged with the first gear 530, a third gear 550 rotating with the second gear 540, a crank gear 560 rotating in a state of being engaged with the third gear 550, a connecting rod 570 connecting the crank gear 560 with a piston 580, a piston 580 transferring positive pressure or negative pressure to the passage switching valve 600 through reciprocating movement thereof and a cylinder 590 defining a space for reciprocating movement of the piston 580.

The first gear 530 is integrally rotated with the motor 520. The first gear 530 may be a helical gear. A helical gear has an advantage of reducing a noise generated in the motor 520 and transferring power easily. The second gear 540 may be a worm gear. Since the pump 500 is installed between the inlet passage 700, the outlet passage 800 and the passage switching valve 600 etc., there is a need to assemble with high density for space efficiency. Therefore, according to an exemplary embodiment of the present disclosure, the motor 520 may be installed horizontally, and the second gear 540 may function as a worm gear so as to switch a direction of rotating power and deliver thereto.

The second gear 540 and the third gear 550 are rotated together. The crank gear 560 is rotated in a state of being engaged with the third gear 550. The crank gear 560 may have greater number of teeth than that of the third gear 550 so as to deliver strong power thereto during reciprocating movement of the piston 580.

The crank gear 560 includes a crank shaft 561 functioning as a rotating axis of the crank gear, a crank arm 562 extended from the crank shaft, and a crank pin 563 connected to the connecting rod 570. The crank pin 563 and the connecting rod 570 are rotatably connected to each other so that the connecting rod 570 is capable of linearly moving along a direction of the cylinder 590 according to rotation of the crank pin 563 during rotation of the crank gear 560.

The connecting rod 570 is connected to the piston 580, and the piston 580 is snugly inserted to the cylinder 590 so as to move reciprocatively along a longitudinal direction of the cylinder 590. At this time, positive pressure or negative pressure may be transferred to the passage switching valve 600 connected to the cylinder 590 through a linear movement of the piston 580. When the piston 580 is moved toward the passage switching valve 600, positive pressure is transferred to the passage switching valve 600, and on the other hand, when the piston 580 is moved along the opposite direction of the passage switching valve 600, negative pressure is transferred to the passage switching valve 600.

Hereinafter, referring to FIG. 5 through FIG. 8 and FIG. 12 through FIG. 16, a structure of a passage switching valve 600 will be described.

A passage switching valve 600 according to an exemplary embodiment of the present disclosure includes an upper housing 610 connected to the cylinder 590 of the pump 500, a lower housing 650 connected to the upper housing 610, a disc 620 rotatably disposed in a space formed between the upper housing 610 and the lower housing 650, a spring valve 630 disposed at the disc 620, a shaft 640 causing the disc 620 to be rotated, a micro switch 660 disposed at a lower side of the lower housing 650 and a passage switching motor 670 causing the shaft 640 to be rotated.

A passage hole 651 respectively connected to inlet passages 700*a*, 700*b*, 700*c*, 700*d*, 700*e*, 700*f* (hereinafter referred to as "700") are disposed at the lower housing 650 so that fluid being passed through a disc hole 621 of the disc 620 may pass through the passage hole 651. And then the fluid is supplied to each inlet passage 700 connected thereto via corresponding passage outlet opening 653.

The spring valve 630 is installed at the disc hole 621 of the disc 620. The spring valve 630 includes a spring 631 providing an elastic force, a spring shaft 632 being coupled to the disc 620 to prevent the spring 631 from being separated, and a cover unit 633 covering the passage hole 651 by an elastic force of the spring 631.

Hereinafter, referring to FIG. 5 through FIG. 8 and FIG. 12 through FIG. 16, an operation of a passage switching valve 600 will be described.

When detergent is selected for being supplied, the passage switching motor 670 is operated by electric power supplied. The passage switching motor 670 rotates the shaft 640 connected thereto and also the disc 620 connected to the shaft 640.

At this time, the spring valve 630 installed at the disc 620 is also integrally rotated corresponding to a rotation of the disc 620, and when the passage hole 651 of the lower housing 650 is positioned at a rotary position of the spring valve 630, the cover unit 633 blocks the passage hole 651 by an elastic force of the spring 631.

The controller 3 may control a rotary angle of the disc 620 so as to prevent the spring valve 630 from positioning at the passage hole 651 fluidly communicated with the check valve assembly 400, so as to connect the check valve assembly 400 which is connected with the cartridge containing detergent for supplying to the tub with the pump 500.

When the spring valve 630 is not placed at the passage hole 651, the spring valve 630 is kept compressed and being contacted with the upper surface 652 of the lower housing. After the pump 500 and the passage hole 651 are fluidly communicated each other, a positive pressure or a negative pressure generated in the pump 500 is transferred via the passage hole 651 to the inlet passage 700 and the check valve assembly 400 sequentially. And then, additive contained in the cartridge 200 may be discharged to the outlet passage 800.

Further, in order to block flow paths between the check valve assembly 400 connected to the cartridges containing detergent which is not in a need to be supplied by the pump 500, the spring valves 630 may be placed at the corresponding passage hole 651 connected to the check valve assemblies 400. And then, it is possible to control a rotary angle of the disc 620 so that the cover units 633 block the corresponding passage hole 651 with an elastic force of the spring 631.

When the spring valve 630 is placed at the passage hole 651, the pump 500 and the passage hole 651 is blocked by the cover unit 633 of the spring valve 630. And, because positive pressure or negative pressure generated in the pump 500 is not transferred to the check valve assembly 400, additive contained in the corresponding cartridge 200 is not flowed.

In order to precisely detect a rotary angle of the disc 620, the passage switching valve 600 includes a micro switch 660 and a planar cam 645. The planar cam 645 may be formed integrally with the shaft 640 or be rotated integrally with the shaft 640 and the disc 620 in a state of being mounted to the shaft 640.

The micro switch 660 may include an actuator, and in doing so an electric signal would be changed by a movement of the actuator.

The cam may be a device which is rotating or reciprocating with particular shapes of protrusions or grooves. The planar cam 645 may be a type of a cam having a surface curved continuously.

Figure 8:
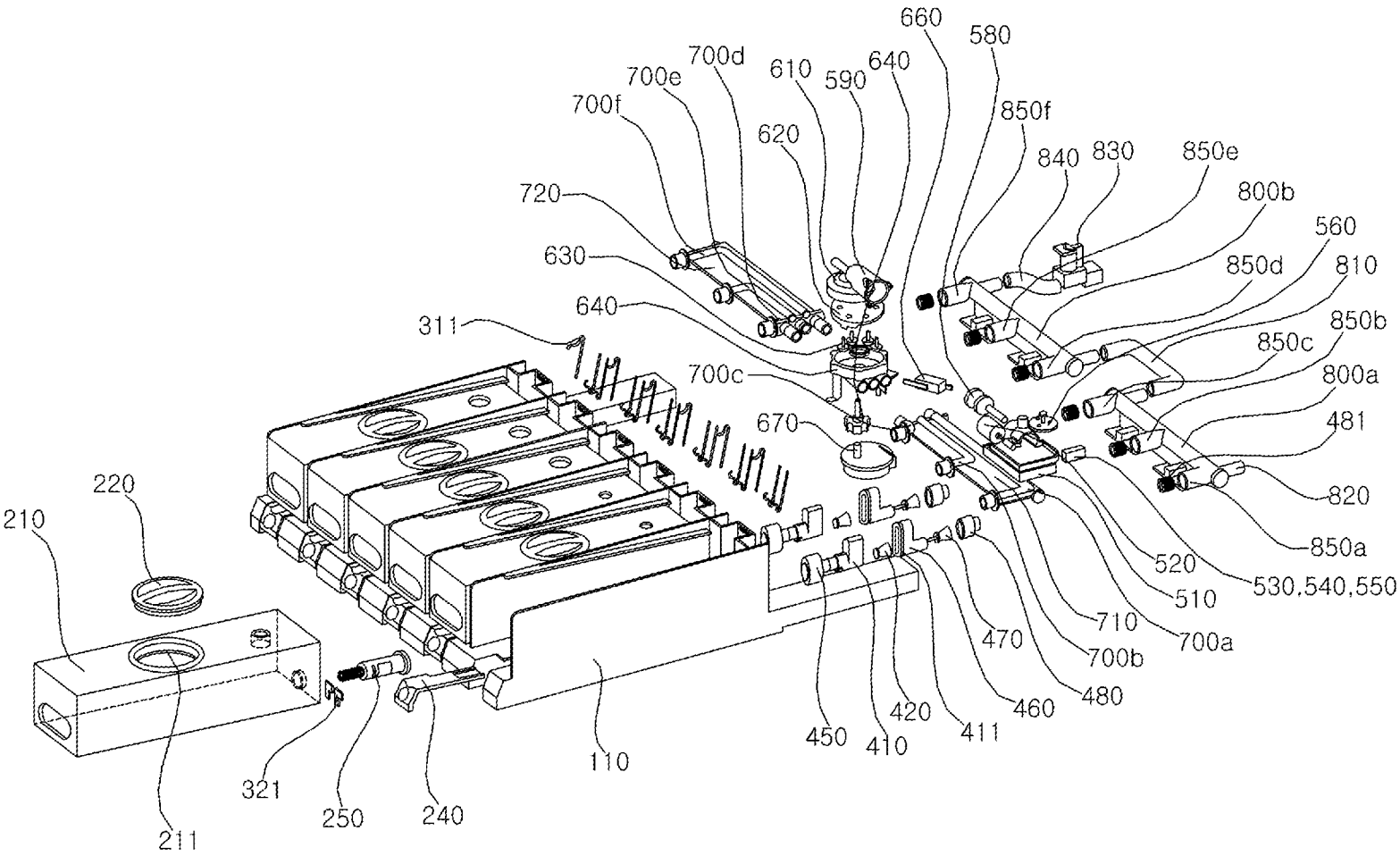
FIG. 8 is an exploded perspective view showing the detergent supply device according to an exemplary embodiment of the present disclosure.
Figure 9:
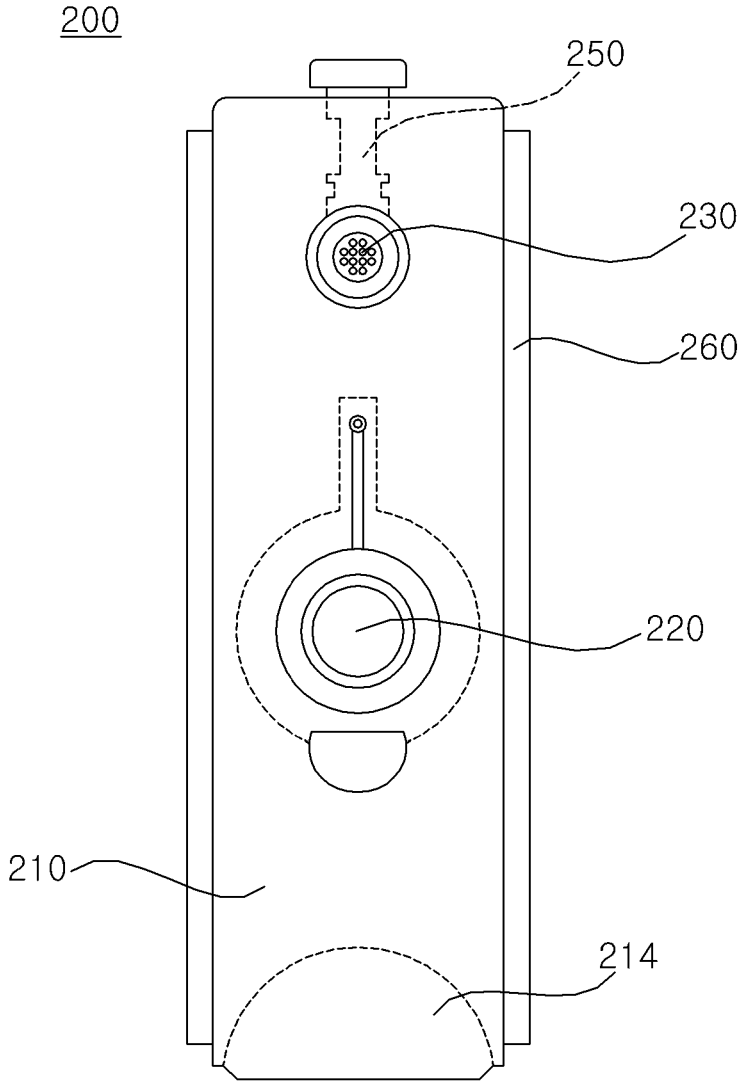
FIG. 9 is a schematic view showing a cartridge of the detergent supply device according to an exemplary embodiment of the present disclosure.
Figure 10:
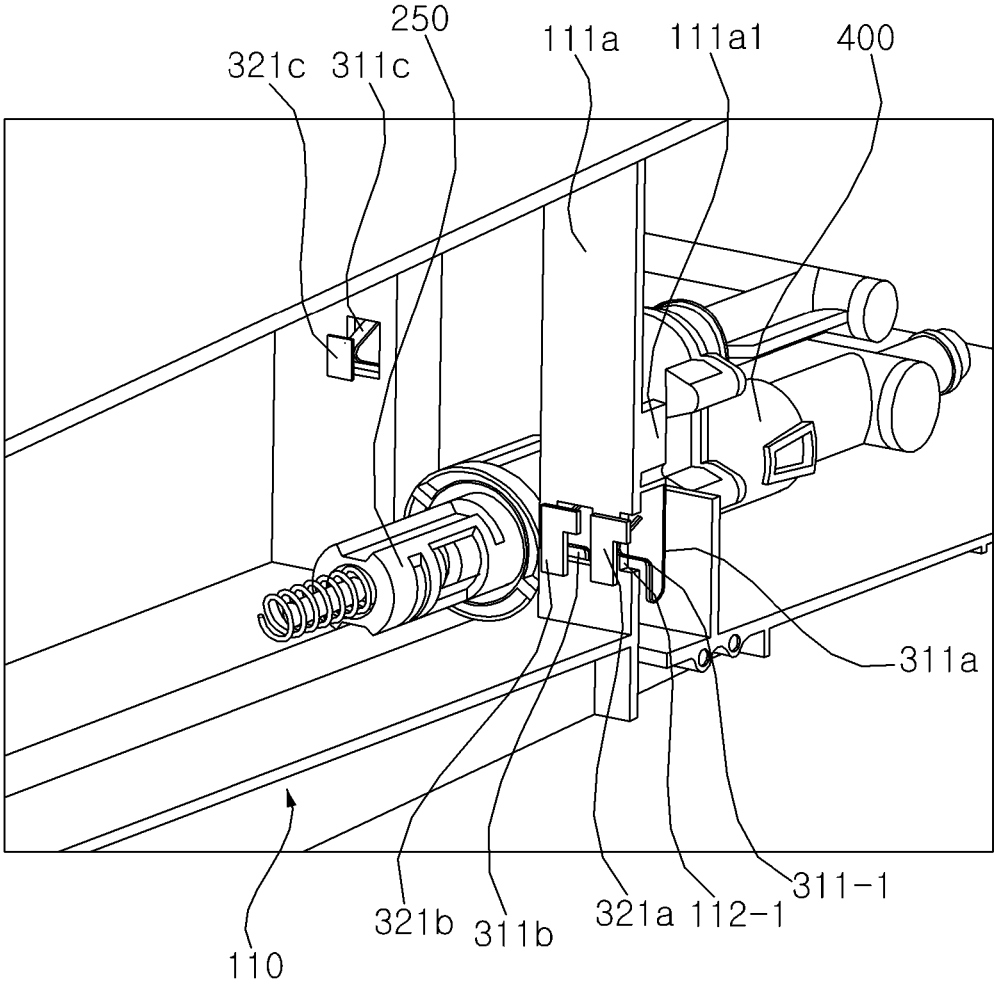
FIG. 10 is a schematic view showing an electrode sensor of the detergent supply device according to an exemplary embodiment of the present disclosure.
Figure 11:
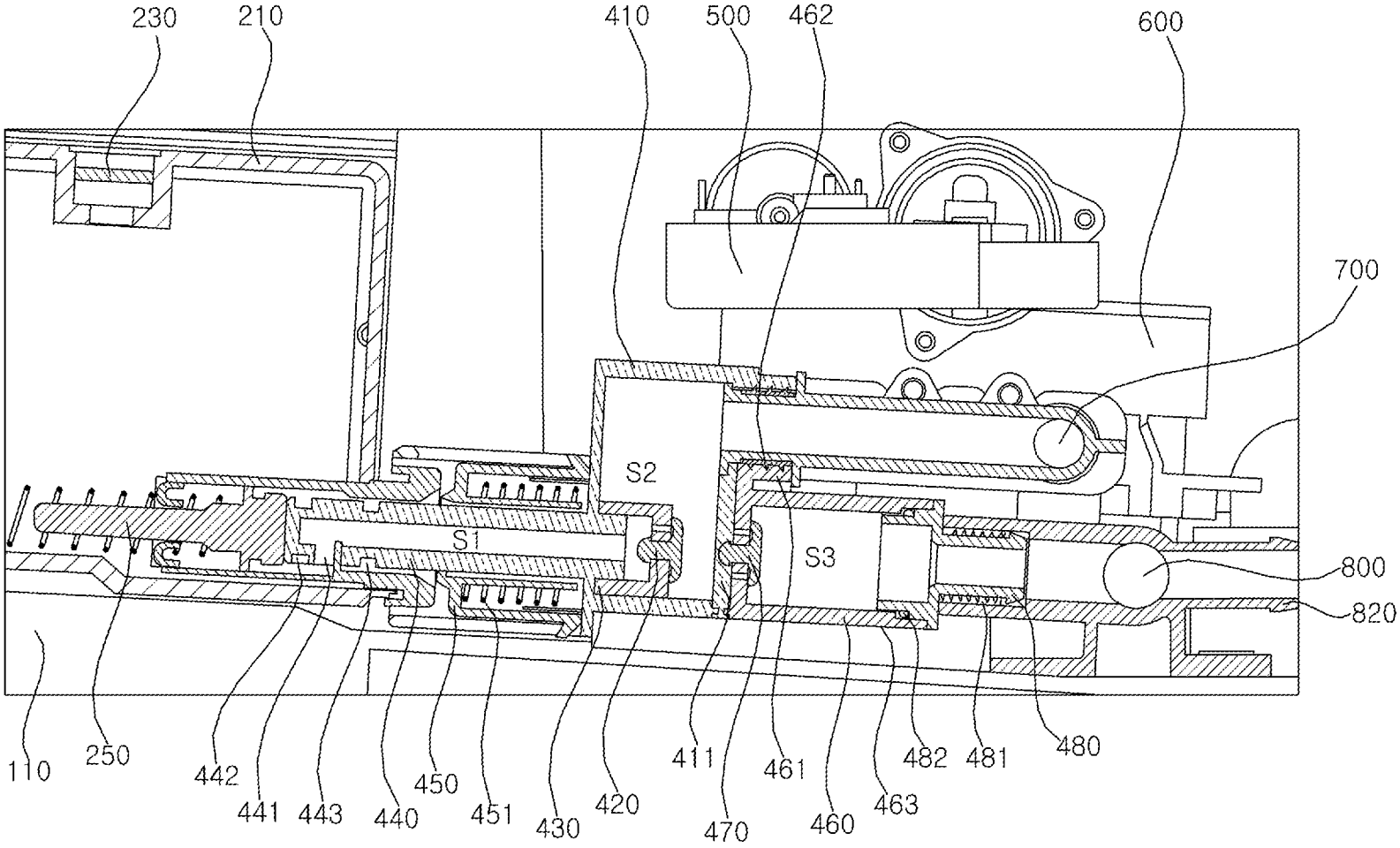
FIG. 11 is a schematic view showing a check valve assembly of the detergent supply device according to an exemplary embodiment of the present disclosure.
Figure 12:
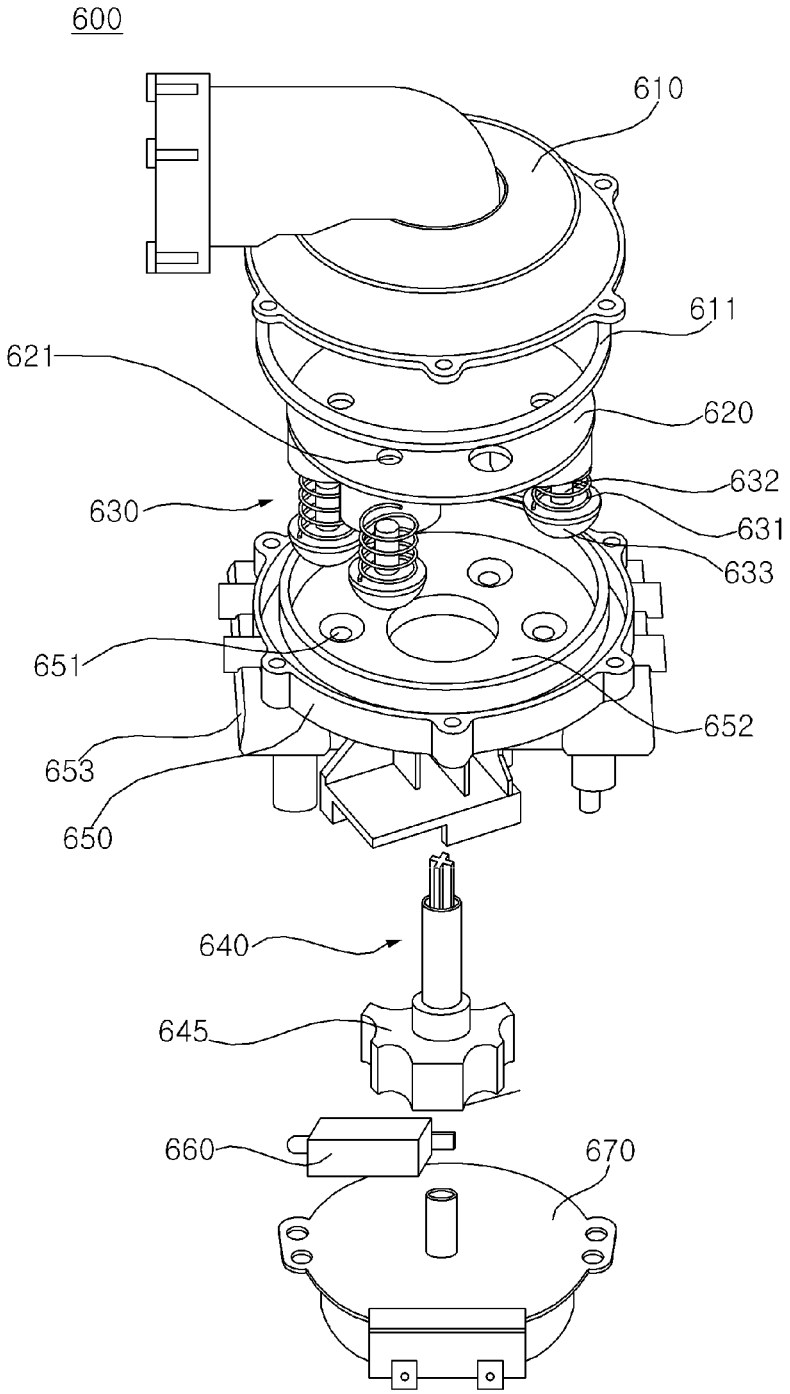
FIG. 12 is a schematic view showing a passage switching valve of the detergent supply device according to an exemplary embodiment of the present disclosure.
Figure 13:
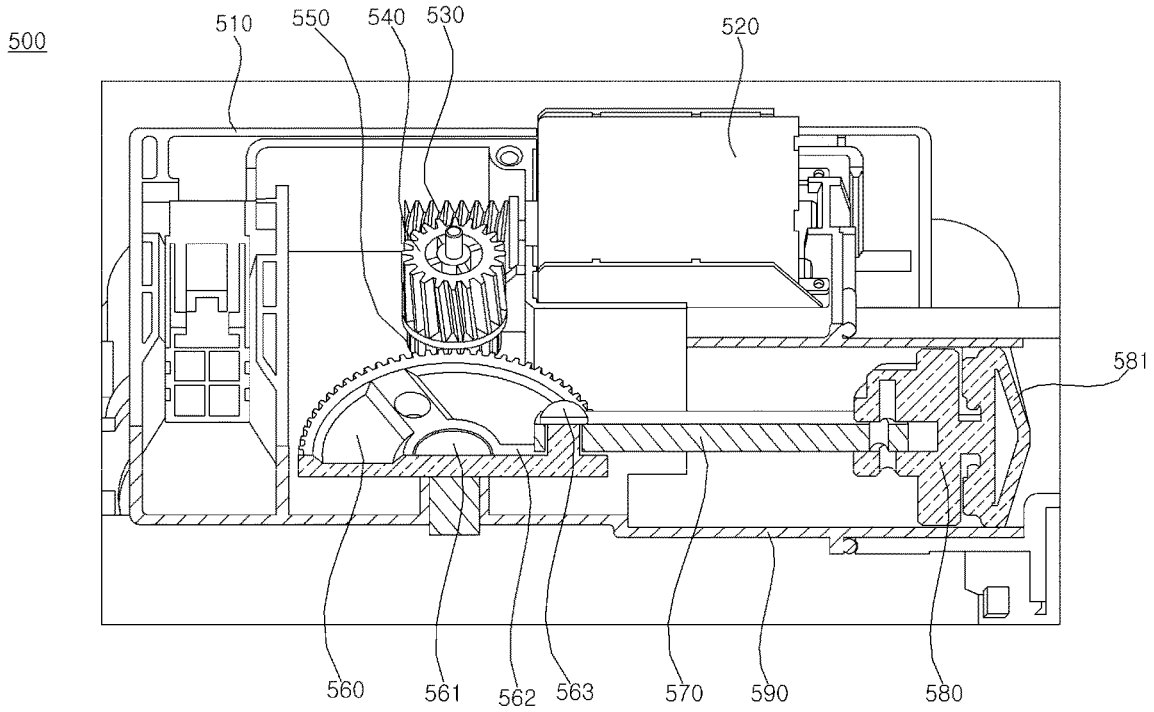
FIG. 13 is a schematic view showing a pump of the detergent supply device according to an exemplary embodiment of the present disclosure.
Figure 14:
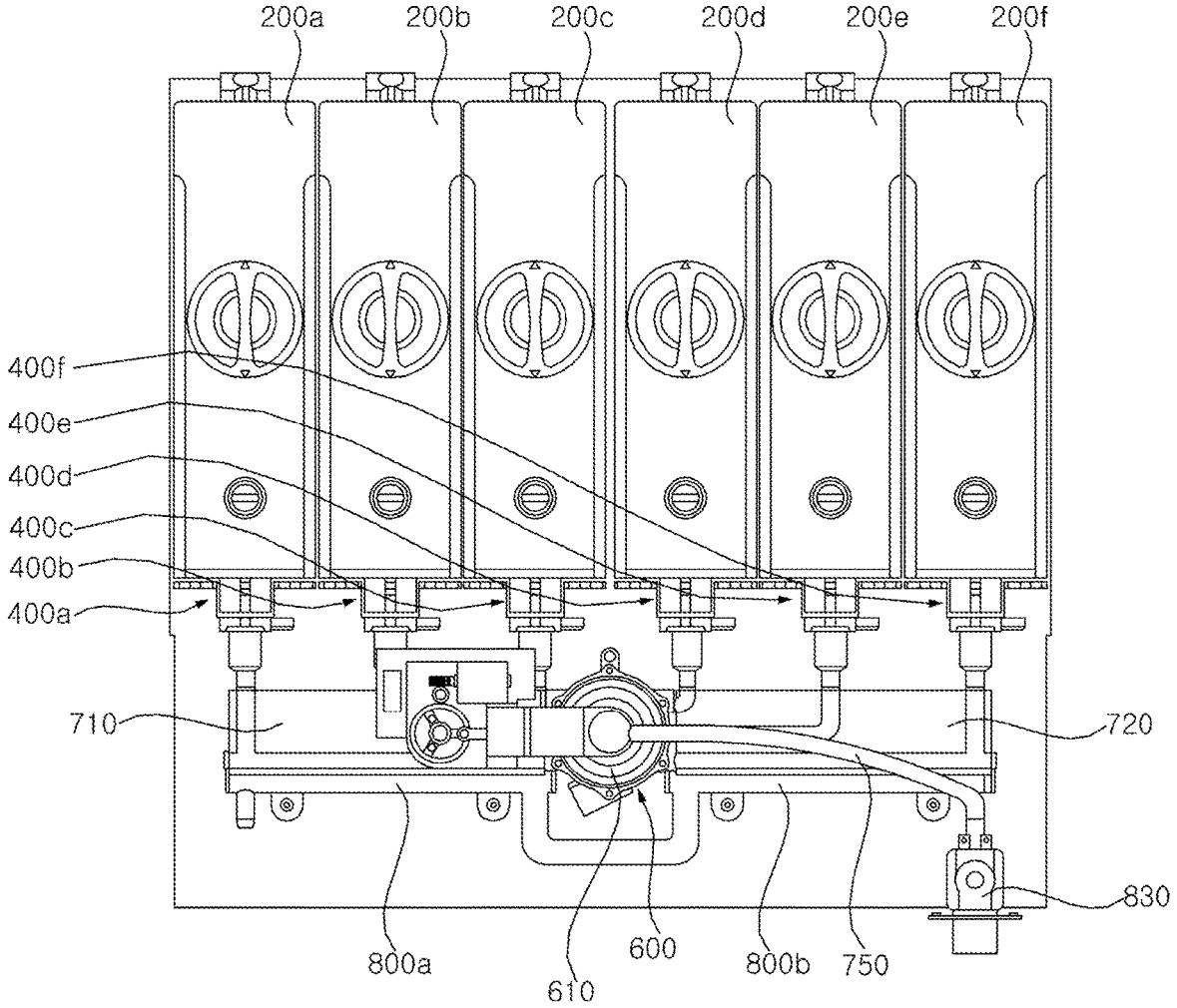
FIG. 14 is a schematic view of the detergent supply device showing a water supply valve connected to the passage switching valve according to an exemplary embodiment of the present disclosure.
Figure 15:
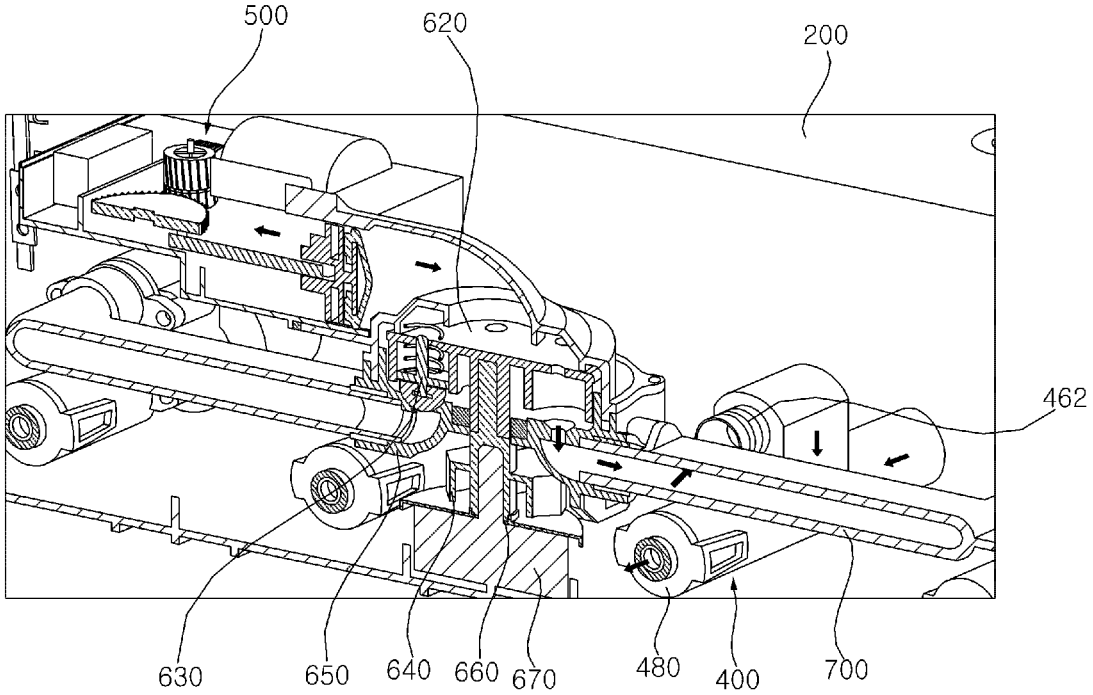
FIG. 15 is a cross-sectional view showing the passage switching valve and parts connected therewith according to an exemplary embodiment of the present disclosure.
Figure 16:
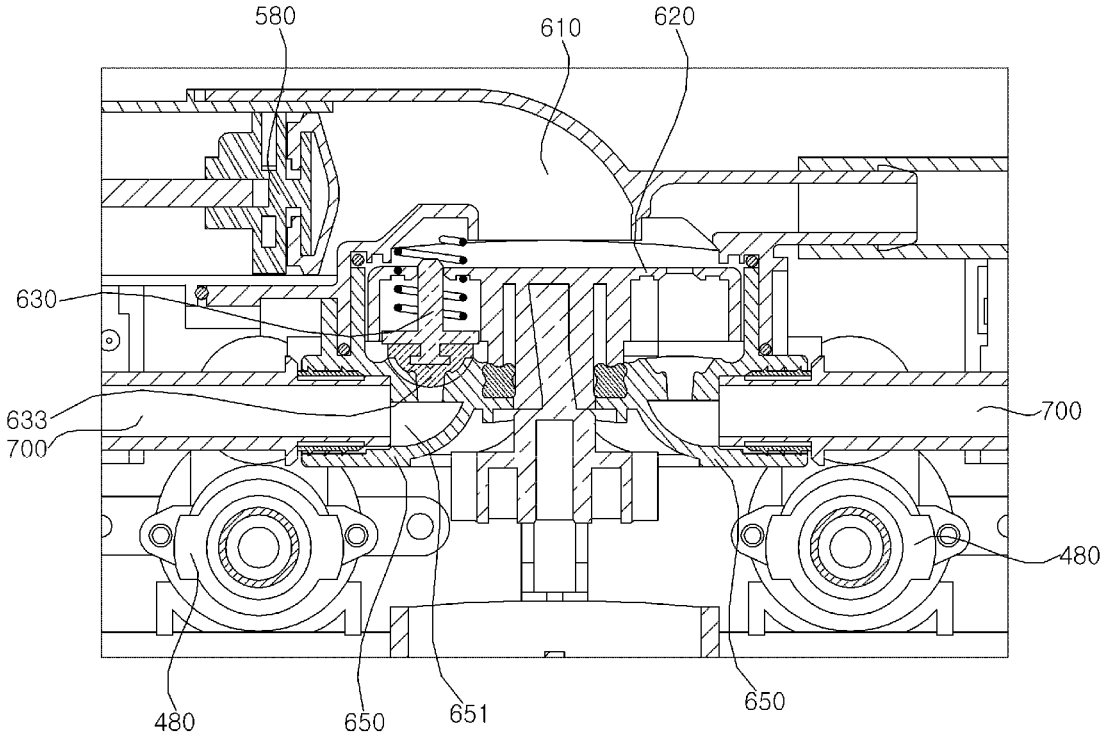
FIG. 16 is a schematic view showing a state that the spring valve functions to block the passage switching valve according to an exemplary embodiment of the present disclosure.

Referring to FIG. 8 and FIG. 12, the planar cam 645 may include a plurality of protrusions having particular contour, wherein the plurality of protrusions have separate shapes and distances spaced apart from each other. At this time, it is possible to provide current flow when the protrusions push the actuator disposed at the micro switch 660 during a rotation of the planar cam 645. The controller 3 may determine and control a rotary position of the disc 620 according to a pattern providing current flow.

When the spring valve 630 of the disc 620 is not placed at a position of the passage hole 651, the spring 631 is placed at the upper surface 652 of the lower housing 650 in a state of being compressed. In a case that the disc 620 is rotated by the passage switching motor 670, when the spring valve 630 is placed at a position of the passage hole 651, the spring 631 is extended so that the cover unit 633 blocks the passage hole 651, and then fluid flow through the passage hole 651 is blocked.

There can be provided with a plurality of the spring valves 630, and in the case at least two or more of the plurality of passage holes 651 can be blocked simultaneously. In this manner, a plurality of passage holes 651 can be opened so as to supply a plurality of additives.

A pressure of air that has flowed through the pump 500 can be transferred through the passage connecting opening 651 opened, and further water that has flowed through the water supply valve 830 can be transferred to the check valve assembly 400.

A procedure of transferring air pressure through the pump 500 will be described in the followings.

The pump 500 includes a piston 580 reciprocating and a cylinder 590 formed as cylindrical shape so as to cause reciprocating movement of the piston 580. A positive pressure or a negative pressure is generated by reciprocating movement of the piston 580 disposed inside the cylinder 590. And, the air pressure of the pump 500 is transferred to the second space S2 of the first check valve housing 410 of the check valve assembly 400 connected to the inlet passage 700 after passing through sequentially the upper housing 610 connected to the cylinder 590, the passage connecting opening 651 formed at the lower housing 650, the passage outlet opening 653 fluidly communicated to the passage connecting opening 651 and the inlet passage 700 connected to the passage outlet opening 653. Therefore, as can be seen from the foregoing, additive contained in a cartridge connected to the check valve assembly 400 can be sucked by a positive pressure or a negative pressure generated in the second space S2.

According to an exemplary embodiment of the present disclosure, water supplied from the water supply valve 830 from an external water source can be supplied to the passages 700, 800. A procedure for supplying water will be described in the followings.

A water supply pipe 750 may be disposed between the water supply valve 830 and the upper housing 610 of the passage switching valve 600. Water supplied through the water supply pipe 750 is guided to the upper housing 610, and is supplied to the second space S2 of the first check valve housing 410 of the check valve assembly 400 connected to the inlet passage 700, after passing through sequentially passage connecting opening 651 disposed at the lower housing 650, passage outlet opening 653 fluidly communicated to the passage hole 651 and the inlet passage 700 connected to the passage hole 653. Water flowed into the second space S2 is guided to the third space S3 and the outlet passage 800 sequentially according to opening of the second check valve 470, and then can be flowed into the tub 31 via a supply port 820.

It is possible to clean the inner circumferences of the check assembly 400, inlet passage 700 and outlet passage 800 clogged by additive by supplying water to the check assembly 400, inlet passage 700 and outlet passage 800.

Hereinafter, referring to FIG. 5 through FIG. 8, the inlet passage 700 and outlet passage 800 will be described.

According to an exemplary embodiment of the present disclosure, inlet passage 700 is connected to the inlet passage connector 461 of the check valve assembly 400, and is connected to the passage hole 653 of the passage switching valve 600 so as to transfer fluid transferred through the pump 500 to the check valve assembly 400.

There is provided with a plurality of inlet passages 700*a*, 700*b*, 700*c*, 700*d*, 700*e*, 700*f* in which the plurality of inlet passages are connected to the plurality of passage holes 653.

According to an exemplary embodiment of the present disclosure, the passage switching valve 600 is disposed at a center thereof, and three cartridges 200 and the check valve assembly 400 connected therewith are respectively connected to the left and right side of the passage switching valve 600.

The inlet passages 700*a*, 700*b*, 700*c* disposed at the left side of the passage switching valve 600 are connected to the left check valve assemblies 400*a*, 400*b*, 400*c* are respectively connected to the inlet passage connectors 461 of the left check valve assemblies 400*a*, 400*b*, 400*c* and the passage hole 653 adjacently disposed at a left side of the passage switching valve 600.

The inlet passages 700*d*, 700*e*, 700*f* disposed at the right side of the passage switching valve 600 are respectively connected to the inlet passage connector 461 and the passage hole 653 adjacently disposed at a right side of the passage switching valve 600.

The inlet passages 700*a*, 700*b*, 700*c* disposed at the left side of the passage switching valve 600 are integrally connected to a first inlet passage plate 710. And, the inlet passages 700*d*, 700*e*, 700*f* disposed at the right side of the passage switching valve 600 are integrally connected to a second inlet passage plate 720. So, the inlet passage is fixedly secured thereto so as to supply fluid stably.

The outlet passage 800 according to an exemplary embodiment of the present disclosure is connected to the outlet passage connector 481 of the check valve assembly 400, so that additive discharged from the outlet passage connector 481 is supplied via the supply port 820 to the tub 31 or drawer 39.

The water supply valve 830 may be disposed at an end of the outlet passage 800 so as to supply water supplied through the external water source to the outlet passage 800, and water supplied through the water supply valve 830' is guided to the outlet passage 800 after passing through a water supply hose 840.

And, the water is flowed along a direction of the supply port 820 disposed at the other end of the outlet passage 800. Further, the water is supplied via the check valve connectors 850*a*, 850*b*, 850*c*, 850*d*, 850*e*, 850*f* connected to the outlet passage connector 481 of the check valve assembly 400, and then is discharged to the supply port 820 with additive from the outlet passage 800.

The check valve connector 850 is connected to a side of the outlet passage 800. Each check valve connector 850 is connected to corresponding the outlet passage connector 480, so that additive discharged from the outlet passage connector 480 is flowed into the outlet passage 800 through the check valve connector 850.

The outlet passage 800 according to an exemplary embodiment of the present disclosure is separately installed at the both sides of the passage switching valve 600 based on the passage switching valve 600. Connecting hose 810 is connected between the two outlet passages 800*a*, 800*b* so as to connect the two outlet passages 800*a*, 800*b*. At this time, the connecting hose 810 is formed as being L-shaped so as to prevent an interference between the outlet passage and the passage switching valve 600, and furthermore it is possible to make a space for installing the passage switching valve 600.

Although the embodiments of the present disclosure are described above with reference to the accompanying drawings, the present disclosure is not limited to the above embodiments, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the embodiments described above are exemplary in all respects and not restrictive.

What is claimed is:

1. A washing machine comprising:

a tub configured to receive water;

a drum rotatably disposed inside the tub and configured to accommodate laundry therein; and a detergent supply device configured to supply detergent to the tub, wherein the detergent supply device comprises:

a plurality of cartridges that are configured to contain detergent, a pump configured to extract the detergent from the plurality of cartridges, and a passage switching valve configured to selectively provide fluid communication between the pump and one of the plurality of cartridges, wherein the passage switching valve comprises:

an upper housing that provides a pump connecting portion protruding upward and connected to the pump and that is connected to a water supply pipe, the water supply pipe provided at the detergent supply device and configured to supply water into the upper housing, a lower housing connected to the upper housing, providing a space between the upper housing and the lower housing, and including a passage outlet opening located below the space, the space and the passage outlet configured to receive the water supplied to the upper housing by the water supply pipe, a disc disposed between the upper housing and the lower housing and including a plurality of disc holes that are spaced apart from each other along a circumferential direction of the disc, the plurality of disc holes facing the space between the upper housing and the lower housing, a plurality of passage holes defined at the lower housing, facing the space between the upper housing and the lower housing, and defined below the plurality of disc holes, and a plurality of spring valves disposed in the space between the upper housing and the lower housing, configured to open or close at least one of the plurality of passage holes, coupled to the plurality of disc holes, and extending from the plurality of disc holes to the plurality of passage holes.

2. The washing machine of claim 1, wherein the pump comprises a cylinder and a piston configured to reciprocate within the cylinder.

3. The washing machine of claim 2, wherein the upper housing is connected to the cylinder and configured to receive a fluid pressure from the pump.

4. The washing machine of claim 1, wherein the detergent supply device further comprises:

a water supply valve configured to receive water from an external water source; and an outlet passage that is configured to pass therethrough detergent contained in at least one of the plurality of cartridges.

5. The washing machine of claim 4, wherein the passage switching valve is connected to the water supply valve and configured to guide water supplied from the water supply valve to the outlet passage.

6. The washing machine of claim 5, wherein the upper housing is configured to receive the water supplied from the water supply valve.

7. The washing machine of claim 6, wherein the water supply pipe connects the upper housing of the passage switching valve and the water supply valve.

8. The washing machine of claim 1, wherein the plurality of spring valves comprise:

a cover unit configured to open or close at least one of the plurality of passage holes, a spring configured to provide an elastic force to the cover unit, and a spring shaft that supports the spring.

9. The washing machine of claim 1, wherein the disc is rotatably provided between the upper housing and the lower housing of the passage switching valve, wherein the plurality of spring valves are installed to the disc, and wherein the plurality of spring valves are configured, based on a rotation of the disc, to open or close the plurality of passage holes.

10. The washing machine of claim 9, wherein the passage switching valve further comprises:

a passage switching motor configured to rotate the disc, and a shaft configured to transfer a rotary power generated by the passage switching motor to the disc.

11. The washing machine of claim 10, further comprising a controller that is configured to control the passage switching motor.

12. The washing machine of claim 11, wherein the passage switching valve further comprises a micro switch that is configured to detect a rotary position of the disc, and wherein the controller is configured, according to the detected rotary position of the disc, to control the rotation of the passage switching motor.

13. The washing machine of claim 9, wherein the plurality of spring valves are inserted into the plurality of disc holes.

14. The washing machine of claim 1, wherein the lower housing further comprises a plurality of passage outlet openings respectively connected to each of the plurality of cartridges, and wherein the plurality of passage outlet openings are fluidly connected to the plurality of passage holes, respectively.

* * * * *